US006427371B2

(12) United States Patent
Olson et al.

(10) Patent No.: US 6,427,371 B2
(45) Date of Patent: Aug. 6, 2002

(54) PICTURE FRAME

(76) Inventors: David V. Olson; Lois J. Olson, both of 689 Sunset Ct., Shoreview, MN (US) 55126

( * ) Notice: Subject to any disclaimer, the term of this patent is extended or adjusted under 35 U.S.C. 154(b) by 0 days.

(21) Appl. No.: 09/733,829

(22) Filed: Dec. 11, 2000

Related U.S. Application Data

(63) Continuation-in-part of application No. 09/295,020, filed on Apr. 20, 1999, now abandoned.
(60) Provisional application No. 60/082,337, filed on Apr. 20, 1998.

(51) Int. Cl.[7] ..... A47G 1/06
(52) U.S. Cl. ..... 40/789; 40/124.14; 40/788; 229/115
(58) Field of Search ..... 40/789, 788, 786, 40/774, 124.06, 124.14; 229/115

(56) References Cited

U.S. PATENT DOCUMENTS

| | | | | | |
|---|---|---|---|---|---|
| 91,728 | A | | 6/1869 | Eastman | |
| 1,347,269 | A | * | 7/1920 | Greble | 40/750 |
| 1,421,097 | A | * | 6/1922 | Pente | 40/754 |
| 2,881,662 | A | * | 4/1959 | Harris | 40/789 |
| 4,275,517 | A | | 6/1981 | Blanchard | |
| 4,366,636 | A | | 1/1983 | Hearsh | |
| 4,780,975 | A | * | 11/1988 | Friedman | 40/155 |
| 4,854,060 | A | | 8/1989 | Corbo et al. | |
| 5,325,960 | A | * | 7/1994 | Sims | 229/115 |
| 5,337,949 | A | * | 8/1994 | Seeley | 229/92.8 |
| 5,361,521 | A | * | 11/1994 | Burtch | 40/152.1 |
| 5,592,768 | A | | 1/1997 | Testa | |
| 5,678,756 | A | * | 10/1997 | Sugiura | 40/789 |
| 5,950,341 | A | * | 9/1999 | Cross | 40/789 |
| 6,059,101 | A | * | 5/2000 | Gambardella et al. | 40/789 |

* cited by examiner

*Primary Examiner*—Jack Lavinder
*Assistant Examiner*—James M. Hewitt

(57) ABSTRACT

The disclosure is directed to several related forms of PICTURE FRAMES for displaying photographs or similar illustrations. More particularly, the disclosure is directed to picture frames constructed from a single flat die-cut foldable paperboard blank convertible into a three-dimensional picture frame without requiring the use of adhesive, adhesive tape, staples, clips or other fastening materials. This is accomplished by the use of rectangular paperboard panels approximately the size of the photo or other picture to be displayed, with infolding flaps on at least three edges of the panel to engage the edges of the photo to entrap the photo and hold it in place.

4 Claims, 3 Drawing Sheets

PICTURE FRAME

Reference is made to United States Provisional Patent Application Serial No. 60/082,337 filed Apr. 20, 1998.

This application is a continuation-in-part of application Ser. No. 09/295,020 filed Apr. 20, 1999 now abandoned.

FIELD OF THE INVENTION

Background of the Invention

This invention is directed to several related forms of PICTURE FRAMES for displaying photographs or similar illustrations. More particularly, the invention is directed to picture frames constructed from a single flat die-cut foldable paperboard blank convertible into a three-dimensional picture frame without requiring the use of adhesive, adhesive tape, staples, clips or other fastening materials. This is accomplished by the use of rectangular paperboard panels approximately the size of the photo or other picture to be displayed, with infolding flaps on at least three edges of the panel to engage the edges of the photo to entrap the photo and hold it in place.

DESCRIPTION OF THE PRIOR ART

Eastman Patent No. 91,728 shows a simple single-fold-two panel photo holder. Friedman Patent No. 4,780,975 shows a single panel display adapted to be a self-mailer. Hearsch Patent No. 4,366,636 shows a two sided easel display device. Blanchard Patent No. 4,275,517 shows a conventional appearing single panel display with a cover which serves as a partial support. Testa Patent No. 5,592,768 shows a display device having separate front and back walls which can be expanded from a flat structure to a three dimensional elliptical shape device by folding inner flaps. Corbo Patent No. 4,854,060 shows a structure which can display up to six photos which, with the aid of a rubber band snaps from a flat mailable structure to a three dimensional display device.

SUMMARY OF THE INVENTION

Broadly stated the invention is directed to a device for displaying one or more rectangular photographs or similar pictures, the device being composed of a single flat die-cut foldable paperboard blank convertible into a three-dimensional picture frame without the necessity of the use of adhesive or other fastening materials. The paperboard blank includes at least one first rectangular panel approximately the size of the photograph to be displayed with an opening in the panel through which the photo may be viewed. The first panel has a pair of flaps connected along fold lines on two opposed edges of the panel and foldable inwardly toward the back of the photo to be displayed. Another second rectangular panel is connected to an edge of the first panel along a fold line extending between the first named flaps and also is foldable inwardly toward the back of the photo to be displayed. The other panel and flaps when folded inwardly engage three edges of the photo to entrap it and hold it in place. A third panel is connected to the second panel along a fold line and is also foldable inwardly toward the back of the photo. A connection composed of a flap connected along a fold line to the third panel engages the back of the first panel and maintains the device in three-dimensional configuration.

BRIEF DESCRIPTION OF THE DRAWING

The invention is illustrated in the accompanying drawings in which corresponding parts are identified by the same numerals and in which.

DETAILED DESCRIPTION OF THE PREFERRED EMBODIMENTS

Figure 1:
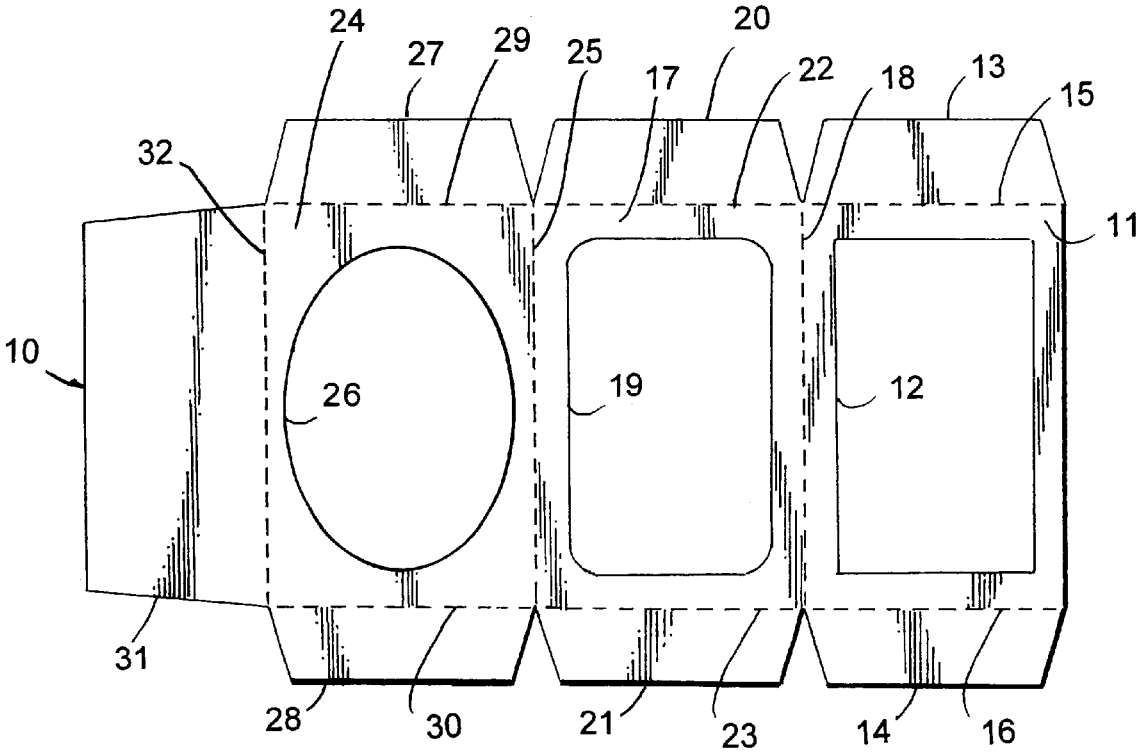
FIG. 1 is a plan view of a die-cut paperboard blank from which one form of photo display device may be formed.

Referring now to the drawings, and particularly to FIG. 1, there is shown a flat blank, indicated generally at 10, formed from paperboard such as heavy weight paper or light weight cardboard, which is stiff but also readily foldable. Paperboard blank 10 includes a first rectangular panel segment 11 of approximately the size of the photograph or other picture to be displayed and opening 12 through which the photograph may be viewed, converting the panel 11 into a picture frame. A pair of flap segments 13 and 14 are connected to opposite edges of panel segment 11 along fold lines 15 and 16, respectively. When a photograph is placed over panel 11 to be viewed through opening 12, flaps 13 and 14 are folded inwardly on top of the back of the photograph to partially entrap the photograph in the frame.

Blank 10 includes a second panel segment 17 which is of the same size as panel 11 and is connected thereto along a fold line 18. Panel 17 may also have an opening 19 through which a picture may be viewed. A pair of flap segments 20 and 21 are connected to opposite side of panel 17 along fold lines 22 and 23, respectively.

Blank 19 includes a third panel 24 connected to panel 17 along fold line 25. Panel 24 may have an opening 26 through which a photograph my be viewed, along with flaps 27 and 29 connected along fold lines 29 and 30, respectively. A further assembly flap 31 which extends the full length of panel 24 is connected thereto along fold line 32. The ends of the flaps are preferably tapered as shown. Openings 12, 19 and 26 are representative of various configurations of frame openings which may be used.

Figure 2:
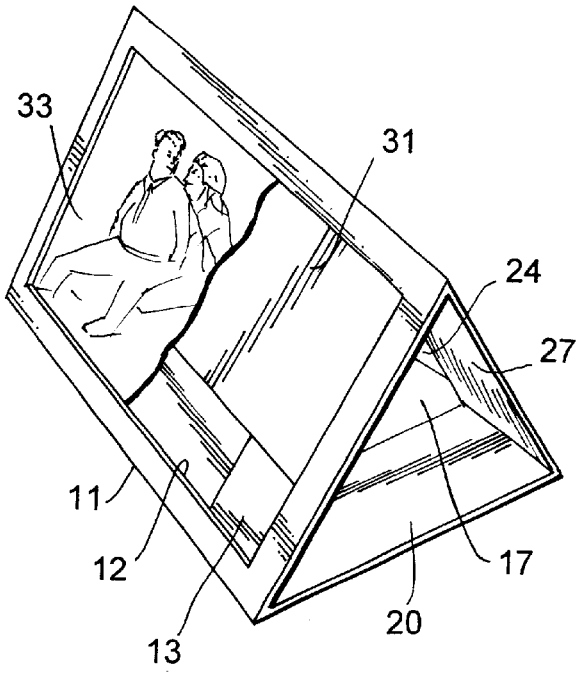
FIG. 2 is a perspective view of a three-dimensional photo display device formed from the blank of FIG. 1.

To form a frame as shown in FIG. 2, the photographs to be displayed are laid face down over the openings in each panel. The panel end flaps 13, 14, et al are folded inwardly over the backs of the photographs to partially entrap them in the frames. Panels 11 and 24 are folded upwardly along their fold lines with panel 17 and their edges ate brought together so that assembly flap 31 may be inserted in the space behind photograph 33 between the photograph and flaps 13 and 14 on panel 11. Flap 31 frictionally engages the insides of fold lines 15 and 16 to form the rigid three-dimensional structure shown in FIG. 2, without the means of adhesive or adhesive tape or staples or other fastening means.

The edges of the infolded panels along their folded fold lines serve to further entrap the photos being displayed. When the three-dimensional frame is in prism format as shown, photographs are displayed on the two exposed prism faces. Panel 17 which forms the prism base need not have an opening. However, if it does, as shown in blank 10, then the frame structure can be rotated to alternately display any two of the three framed photos. On the other hand, if the photographs are in vertical format the prism structure can be placed on its end and all three photographs are always on display.

Figure 3:
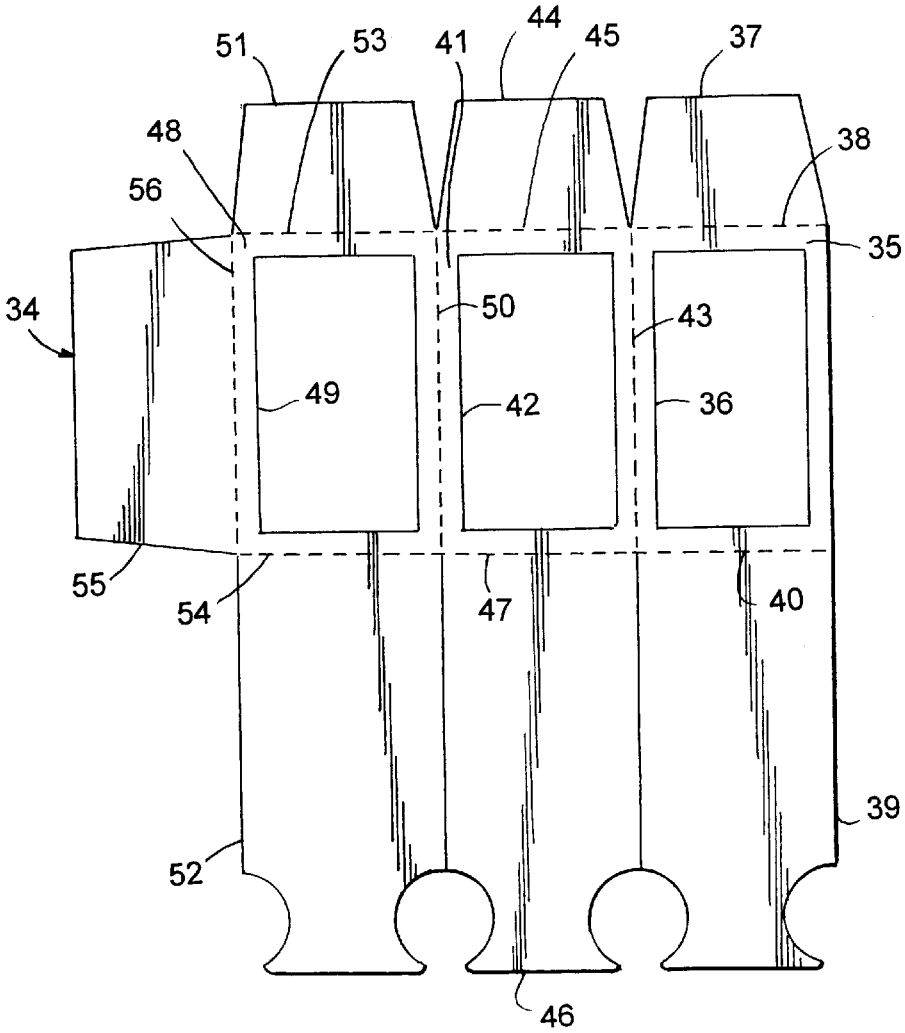
FIG. 3 is a plan view of a second form of die-cut paperboard blank.

Referring now to FIG. 3, there is shown a paperboard blank, indicated generally at 34, for making a second form of three dimensional photo display. Blank 34 has a first rectangular panel segment 35 having an opening 36 therein. A flap segment 37 is joined to panel segment 35 along a fold line 38. A pedestal flap segment 39 is connected to the opposite side of panel segment 35 along fold line 40. Flap 39 is of a length greater than the length of panel 35.

A second panel segment 41 has an opening 42 therein and is connected to panel segment 35 along fold line 43. A flap segment 44, similar to flap 37, is connected to one edge of panel segment 41 along fold line 45. A pedestal flap segment 46, similar to flap segment 39 is connected to the opposite side of panel 41 along fold line 47. A third panel segment 48 having an opening 49 is connected to panel segment 41 along fold line 50. Flaps 51 and 52 are connected to opposite sides of panel 48 along fold lines 53 and 54, respectively. An assembly flap 55 is connected to the opposite side of third panel segment 48 along fold line 56.

Figure 4:
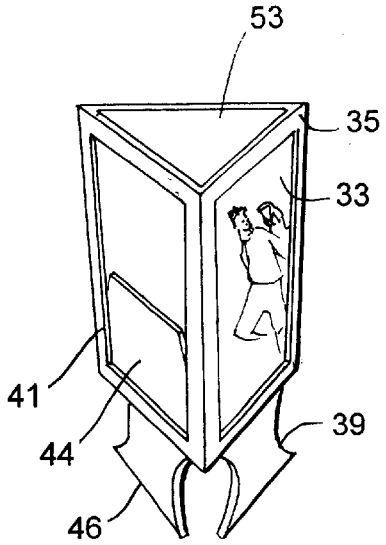
FIG. 4 is a perspective view of a three-dimensional photo display divice formed from the blank of FIG. 3.

To form a three dimensional photo display as shown in FIG. 4, photographs are placed face down over each of the openings in the panel segments. Flaps 37, 44 and 51 are folded inwardly on top of the backs of the photos. Pedestal flaps 39, 46 and 52 are folded inwardly on top of the photos and flaps 37, 44 and 51, respectively. Panel segment 48 is folded upwardly along fold line 50 relative to panel 41 and panel 35 is folded upwardly along fold line 33 relative to panel 41. The edges of panels 48 and 35 are brought together so that assembly flap 55 folded inwardly on fold line 56 may be inserted behind the photograph on panel 35 and in the space between the photograph and flaps 37 and 39 to frictionally engage the insides of fold lines 38 and 40 and form a rigid three-dimensional structure. The portions of the pedestal flaps which extend beyond the rectangular panels form a base to support the three dimensional photo display. Alternatively, the structure may be inverted and the protruding portions of the pedestal flaps function as finials on which school or sports symbols or corporate logos or the like may be displayed.

Figure 5:
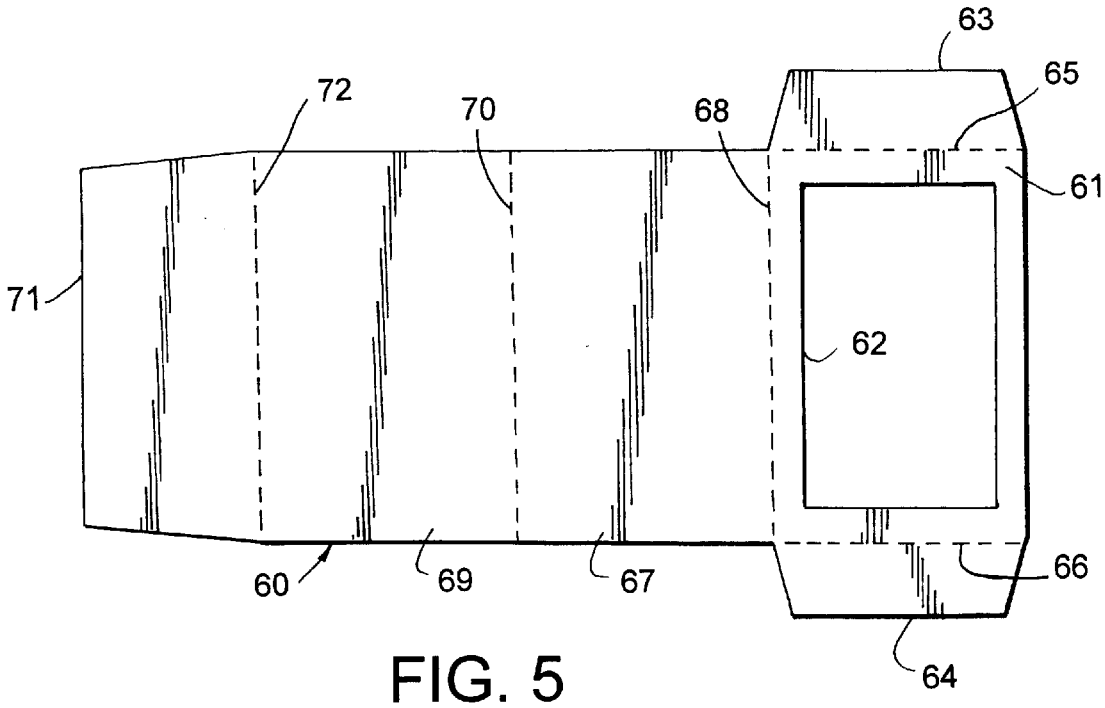
FIG. 5 is a plan view of a third form of die-cut paperboard blank convertible into a mailer and a three dimensional photo display device.

Referring now to FIG. 5 there is shown a paperboard blank, indicated generally at 60, for the formation of a prism-type photo display in combination with a mailer for sending the photograph. Blank 60 includes a rectangular panel section 61 having an opening 62. A pair of flap segments 63 and 64 are connected to the frame segment along fold lines 65 and 66, respectively. A second panel 67, which is of the same size as panel 61 but without any opening therein, is connected to panel 61 along fold line 68. A second similar panel 69 without an opening is connected to panel 67 along fold line 70. An assembly flap 71 is connected to panel 69 along fold line 72.

To use blank 60 as a mailer, the photograph to be mailed, and latter displayed, is placed face down over the opening in panel 61. Flaps 63 and 64 are folded inwardly against the back of the photograph. Panel 61 and the entrapped photograph are folded inwardly upon panel 67. Then, the composite panels 61 and 67 are folded flat against panel 69. Assembly flap 72 is folded over the end of the composite structure against the opposite face of panel 67. The flap is temporarily secured by means of a removable pressure sensitive adhesive seal, removable pressure sensitive adhesive tape, or the like. A personal message may be written on the surfaces of panels 67. and/or 69. The address of the recipient may be inscribed on the opposite face of panel 69 and the entire structure may be mailed.

Upon receipt of the mailer by the recipient, the temporary fastening means is removed and the mailer is partially opened sufficient to form the prism-like configuration. Then, assembly flap 71 is inserted in the space behind panel 61 between the back of the displayed photograph 33 and flaps 63 and 64 to form the rigid display device shown.

Figure 6:
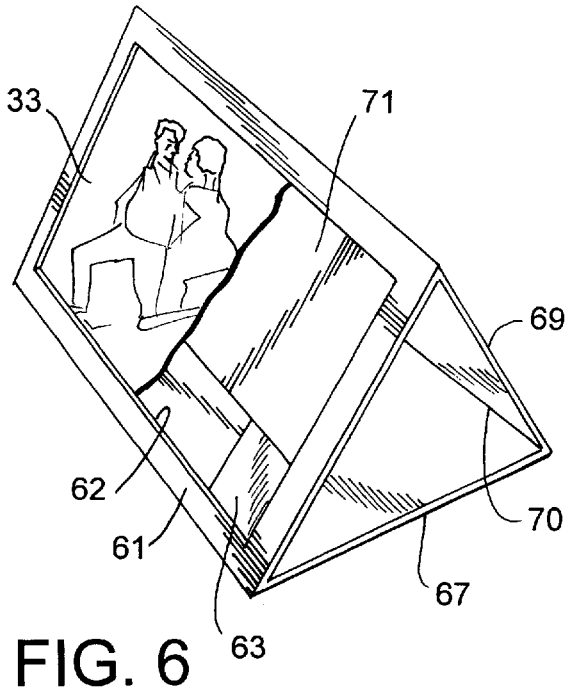
FIG. 6 is a perspective view of a three-dimensional photo display device formed from the blank of FIG. 5.

In each of the configurations shown, the picture to be displayed is held entrapped by folded-in paperboard blank segments on at least three of its four sides. In the configurations of FIGS. 2 and 6 the picture is held entrapped on three sides by in-folded segments of the paperboard blank but the photograph is supported along its fourth side by the assembly flap bearing against the back surface of the picture.

The precut paperboard blanks are preferably scored along the fold lines to facilitate assembly of the picture display devices.

Although the picture display devices as shown and described may be assembled without the use of adhesive or adhesive tape or staples or clips or other fastening devices, so that they are readily assembled and disassembled to change the pictures to be displayed, the use of some auxiliary fastening means is not foreclosed, if its use is desired.

It is apparent that many modifications and variation of this invention as hereinbefore set forth may be made without departing from the spirit and scope thereof. The specific. embodiment described are given by way of example only and the invention is limited only be the terms of the appended claims.

We claim as our invention:

1. A device for displaying at least one rectangular photograph, the device being composed of a single flat die-cut foldable paperboard blank convertible into a three-dimensional picture frame without use of adhesive, adhesive tape, staples, clips or other fastening materials, said paperboard blank including:

A) a first rectangular panel approximately the size of the photograph to be displayed, said panel having two opposed long side edges and two opposed short side edges and an opening therein through which the photograph may be viewed, B) a pair of blank photo-holding flap segments connected along a fold line on each of said two opposed short side edges of said panel and foldable inwardly toward the back of the photograph to be displayed, C) a second rectangular panel of approximately the same size as said first panel, connected to said first panel along a fold line extending between said blank photo-holding flap segments and foldable inwardly toward the back of the photograph to be displayed, D) a third rectangular panel of approximately the same size as one of said first and second panels, connected to said second panel along a fold line spaced from and parallel to the fold line between the first and second panels and foldable inwardly toward said second panel, and E) a further blank assembly flap segment coextensive with said third panel and connected thereto along a fold line opposite from and parallel to said fold line between the second and third panels, said further blank assembly flap segment being foldable toward the third panel and insertable in a space between the blank photo-holding flap segments of the first panel and the back of the photograph to be displayed, when the photo-holding flap segments are infolded on the photograph;

wherein at least one of said second and third panels has an opening therein through which a photograph may be displayed, and said at least one panel has a pair of blank photo-holding flap segments connected along fold lines on opposite short side edges of said at least one panel, each photo-holding flap segment being foldable inwardly toward the back of the photographed.

2. A device according to claim 1 wherein the blank photo-holding flap segments located along one short side edge of each of the rectangular panels having an opening for display of a photograph are longer than the panels to which they are connected and are foldable over the photographs to be displayed through the openings in said panels and over the photo-holding flap segments at the opposite side edges of the panels, and protrude beyond the opposite panel short side edges.

3. A picture frame displaying at least one rectangular photograph, said device being composed of a single flat die-cut foldable paper board blank convertible into a three-dimensional picture frame without use of adhesive, adhesive tape, staples, clips or other fastening materials, said frame including:

A) a first rectangular panel approximately the size of the photograph to be displayed, said panel having two opposed long side edges and two opposed short side edges and an opening therein through which the photograph may be viewed, B) a photograph in abutment with said first panel and positioned to be viewed through said opening, C) a pair of blank photo-holding flap segments connected along a fold line on each of said two opposed short side edges of said panel and folded inwardly toward the back of the photograph to be displayed, D) a second rectangular panel of approximately the same size as said first panel, connected to said first panel along a fold line extending between said blank photo-holding flap segments and folded inwardly toward the photograph to be displayed, E) a third rectangular panel of approximately the same size as one of said first and second panels, connected to said second panel along a fold line spaced from and parallel to the fold line between the first and second panels and folded inwardly toward said second panel, and F) a further blank assembly flap segment coextensive with said third panel and connected thereto along a fold line opposite from and parallel to said fold line between the second and third panels, said further blank assembly flap segment being folded toward the third panel and inserted in a space between the blank photo-holding flap segments of the first panel and the back of the photography;

wherein at least one of said second and third panels has an opening therein through which a photograph may be displayed, a photograph is positioned in abutment with said at least one panel so as to be viewed through said opening and said at least one panel has a pair of blank photo-holding flap segments connected along fold lines on opposite short side edges of said at least one panel, each photo-holding flap segment being foldable inwardly toward the back of the photo been inserted as a separate paragraph.

4. A picture frame according to claim 2 wherein the blank photo-holding flap segments located along one short side edge of each of the rectangular panels having an opening for display of a photograph are longer than the panels to which they are connected and are folded over the photographs displayed through the openings in said panels and over the photo-holding flap segments at the opposite side edges of the panels, and protrude beyond the opposite panel short side edges.

* * * * *